US010412998B2

(12) United States Patent
Hinnershitz

(10) Patent No.: US 10,412,998 B2
(45) Date of Patent: Sep. 17, 2019

(54) LEAK-RESISTANT NURSING APPAREL AND WOMEN'S WEAR

(71) Applicant: NOONI'S LLC, Grand Rapids, MI (US)

(72) Inventor: Lauren Hinnershitz, Grand Rapids, MI (US)

( * ) Notice: Subject to any disclaimer, the term of this patent is extended or adjusted under 35 U.S.C. 154(b) by 121 days.

(21) Appl. No.: 15/709,858

(22) Filed: Sep. 20, 2017

(65) Prior Publication Data

US 2018/0077972 A1 Mar. 22, 2018

Related U.S. Application Data

(60) Provisional application No. 62/397,224, filed on Sep. 20, 2016.

(51) Int. Cl.

| | |
|---|---|
| ***A41C 3/04*** | (2006.01) |
| ***A41C 3/00*** | (2006.01) |
| ***A41D 1/215*** | (2018.01) |

(52) U.S. Cl.

CPC ..... *A41C 3/04* (2013.01); *A41C 3/0014* (2013.01); *A41D 1/215* (2018.01)

(58) Field of Classification Search

CPC ..... A41C 3/04; A41C 3/0057; A41C 3/12; A41D 1/215

USPC ..... 450/36, 37, 39, 30–33

See application file for complete search history.

(56) References Cited

U.S. PATENT DOCUMENTS

| | | | | | |
|---|---|---|---|---|---|
| 4,398,538 | A * | 8/1983 | Johnson | A41C 3/08 | 2/67 |
| 4,572,195 | A * | 2/1986 | Hyams | A41C 5/005 | 156/245 |
| 5,119,511 | A * | 6/1992 | Packer | A41D 7/00 | 2/67 |
| 5,149,336 | A * | 9/1992 | Clarke | A61F 13/141 | 604/358 |
| 5,269,720 | A * | 12/1993 | Moretz | A41B 9/004 | 2/267 |
| 5,479,791 | A * | 1/1996 | Osborne | A41C 3/0014 | 2/73 |

(Continued)

FOREIGN PATENT DOCUMENTS

| | | | | |
|---|---|---|---|---|
| WO | WO2008029220 A1 | 3/2008 | | |
| WO | WO-2008029220 A2 * | 3/2008 | | A41C 3/04 |

(Continued)

*Primary Examiner* — Gloria M Hale

(74) *Attorney, Agent, or Firm* — Haynes and Boone, LLP

(57) ABSTRACT

A nursing garment that includes a back portion comprising a back layer; and a front portion coupled to the back portion. The front portion includes an external layer; a first middle layer that includes a leak-resistant fabric having at least one edge that is cut on the bias; a second middle layer that includes an absorbent material; and an innermost layer configured to be in contact with a nipple of a user, wherein the innermost layer includes a fabric configured to wick moisture away from the nipple of the user. The external layer, the first middle layer, the second middle layer and the innermost layer are coupled together such that the first middle layer extends between the external layer and the second middle layer, and the second middle layer extends between the first middle layer and the innermost layer.

20 Claims, 8 Drawing Sheets

(56) References Cited

U.S. PATENT DOCUMENTS 5,592,836 A * 1/1997 Schuster ..... A41C 3/0014 450/156
5,605,060 A * 2/1997 Osborne ..... A41C 3/0014 2/69
5,944,579 A * 8/1999 Fleischman ..... D04B 1/24 2/73
6,125,664 A * 10/2000 Browder, Jr. ..... A41C 3/0014 450/92
6,276,175 B1 * 8/2001 Browder, Jr. ..... A41B 9/001 2/409
6,622,312 B2 * 9/2003 Rabinowicz ..... A41C 3/0014 2/401
9,232,823 B2 * 1/2016 Mitchell ..... A41C 3/0057
2002/0152775 A1 * 10/2002 Browder, Jr. ..... A41B 9/001 66/170
2003/0230120 A1 * 12/2003 Mitchell ..... A41C 3/0014 66/171
2004/0014394 A1 * 1/2004 Mitchell ..... A41C 3/0014 450/65
2005/0004542 A1 * 1/2005 Bakkila ..... A47G 23/032 604/367
2005/0026539 A1 * 2/2005 Mitchell ..... A41C 3/0014 450/1
2005/0266770 A1 * 12/2005 Henricksen ..... A41C 3/0007 450/1
2006/0021388 A1 * 2/2006 Mitchell ..... A41C 3/0014 66/176
2013/0312157 A1 * 11/2013 Freddi ..... A41D 1/06 2/227
2014/0259304 A1 * 9/2014 Mitchell ..... A41C 3/0057 2/400

FOREIGN PATENT DOCUMENTS

WO WO-2017192049 A1 * 11/2017 ..... A41C 3/0057
WO WO2017192049 A2 11/2017

* cited by examiner

LEAK-RESISTANT NURSING APPAREL AND WOMEN'S WEAR

CROSS-REFERENCE TO RELATED APPLICATION

This application claims the benefit of the filing date of U.S. Application No. 62/397,224, filed Sep. 20, 2016, the entire disclosure of which is incorporated herein by reference.

TECHNICAL FIELD

This disclosure relates to women's apparel in general, and garments designed for pregnant and/or nursing mothers. More particularly, this disclosure relates to leak-resistant maternity and or nursing breast support that may be incorporated in women's garments to facilitate the process of breast-feeding, while providing the mother security from leaks and maximum comfort for her breasts. The embodiments of the present disclosure serve at least three functions. The first function is to provide seamless leak-resistance, with the added coverage of multiple layers of material that in combination, wick away, absorb, and contain breast milk to prevent leakage and stains. The second function is to provide support and comfort to women experiencing pre- and post-partum breast discomfort. The third function is to make the breasts easily accessible for nursing.

BACKGROUND

Generally, lactating mothers use external or separate, reusable nursing pads that can be placed between the breast and a nursing brassiere or garment top. These nursing pads can also be disposable and only single-use pads. One of the flaws with nursing pads is the lack of security from leaks, since many pads do not stay in place and instead shift away from the nipple. Additionally, the pads are often made of materials that absorb, but do not prevent the breast milk from leaking through onto a garment top. As a result, the user may experience an embarrassing leak and possible damaging stain on her clothing (e.g., pajamas). Another flaw with nursing pads is that they can cause discomfort and pain for the user, since many reusable nursing pads are made of materials that stick to nipples that may be chapped as a result of early breastfeeding. Another flaw with nursing pads is the inconvenience associated with their use, since nursing pads must be removed for access during nursing. As such, the nursing pad may become lost or otherwise misplaced. Once nursing is complete, and when the nursing pad is not misplaced or otherwise lost, the user must reposition the nursing pad between the breast and the nursing brassiere or garment top, which is often difficult and/or time consuming. Yet another flaw with nursing pads is that they are indiscreet, because nursing pads tend to be visible through clothing. As such, it can be difficult or impossible to disguise their use.

Conventional nursing garments, or apparel that allows mothers to breastfeed without disrobing, require the use of an incorporated or an external (i.e., separate) nursing brassiere. These brassieres provide support in a similar fashion to that used by traditional brassieres. However, one of the flaws inherent in the brassiere's design is that no leak-resistance is provided. That is, the brassiere is not capable of absorbing and/or containing leaking breast milk. As a result, the user must use an external, inconvenient, indiscreet nursing pad, or risk an embarrassing leak that may also stain their clothing. Another flaw in the brassiere's design is the lack of comfort, since the material may not be kind (e.g., irritate or stick) to sore nipples, damaged during the early days of breastfeeding.

BRIEF DESCRIPTION OF THE DRAWINGS

The advantages and features of the present invention will become readily apparent after reading the following detailed description and referencing the drawings. In order to facilitate a fuller understanding of the present invention, reference is made of the drawings, which should not be construed as limiting the present invention, but are intended to be exemplary only and which are.

DETAILED DESCRIPTION

The present disclosure relates to leak-resistant nursing apparel and women's wear that provides a solution to the aforementioned flaws and disadvantages. That is, the leak-resistant nursing apparel and women's wear of this disclosure provides leak-resistant, comfortable, convenient and discreet support, and access to the breasts without requiring additional external nursing pads.

Figure 1:
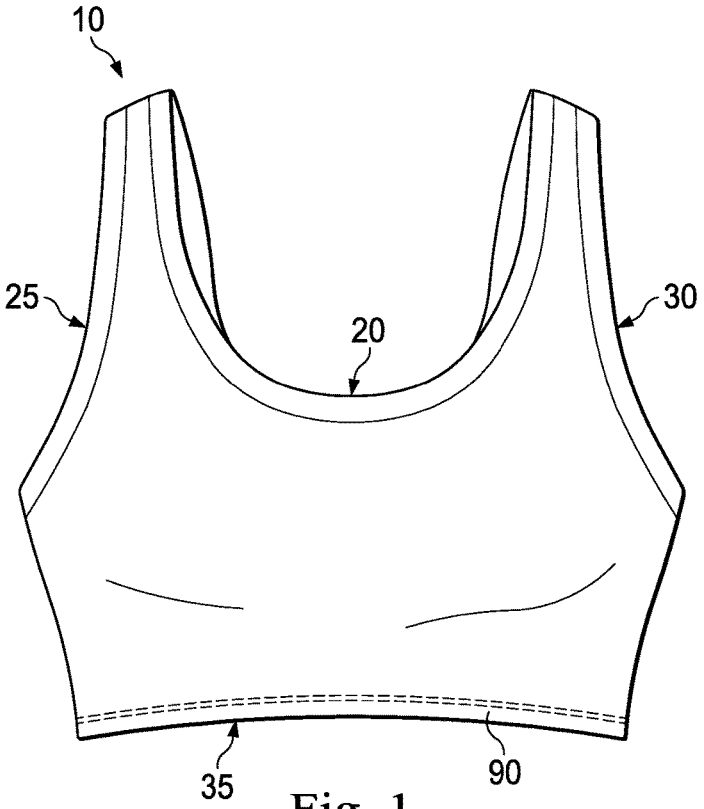
FIG. 1 is a front view of a garment having a front portion and an opposing back portion, according to an exemplary embodiment.

In an exemplary embodiment, as illustrated in FIG. 1, a garment is generally referred to by the reference numeral 10.

Figure 6A:
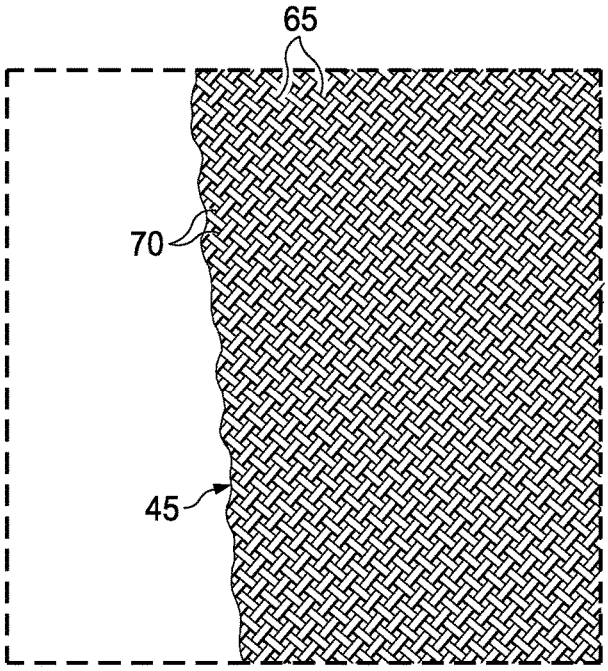
FIG. 6A is an enlarged view of a portion of the second layer of FIG. 6, according to one embodiment.
Figure 3:
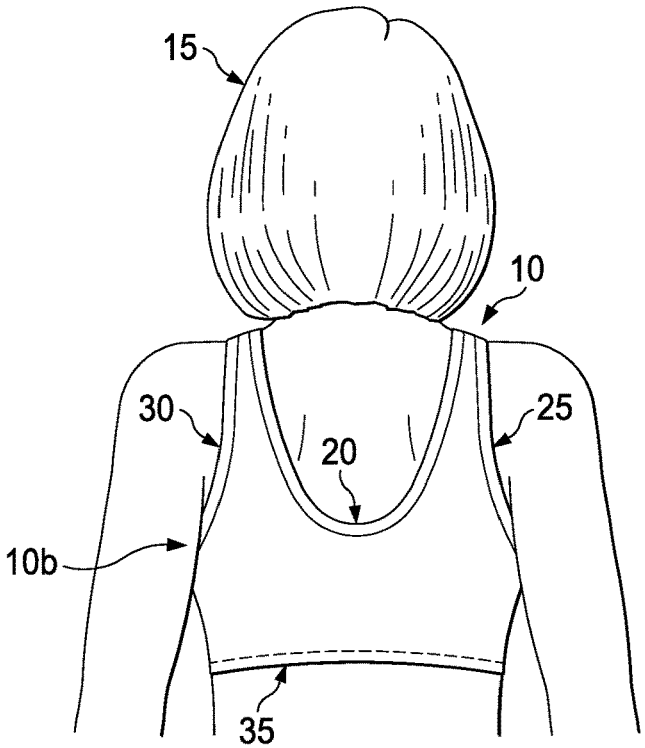
FIG. 3 is a back view of the garment of FIG. 1 in the first configuration and the user, according to an exemplary embodiment.
Figure 4:
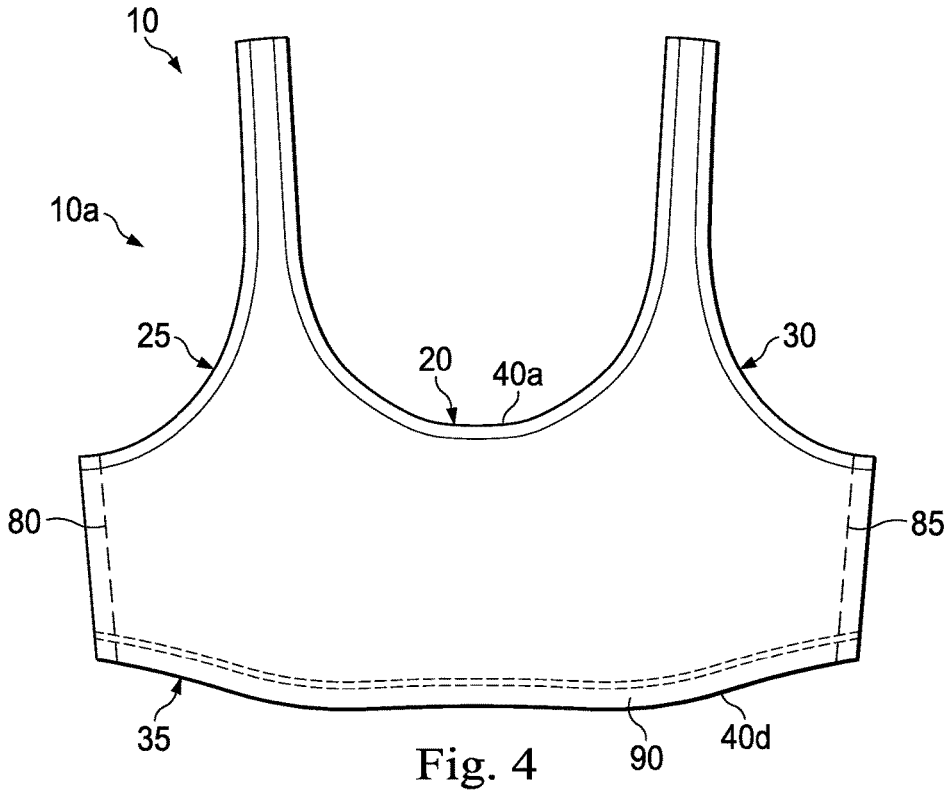
FIG. 4 is an external front view of the front portion of the garment of FIG. 1, according to an exemplary embodiment.
Figure 5:
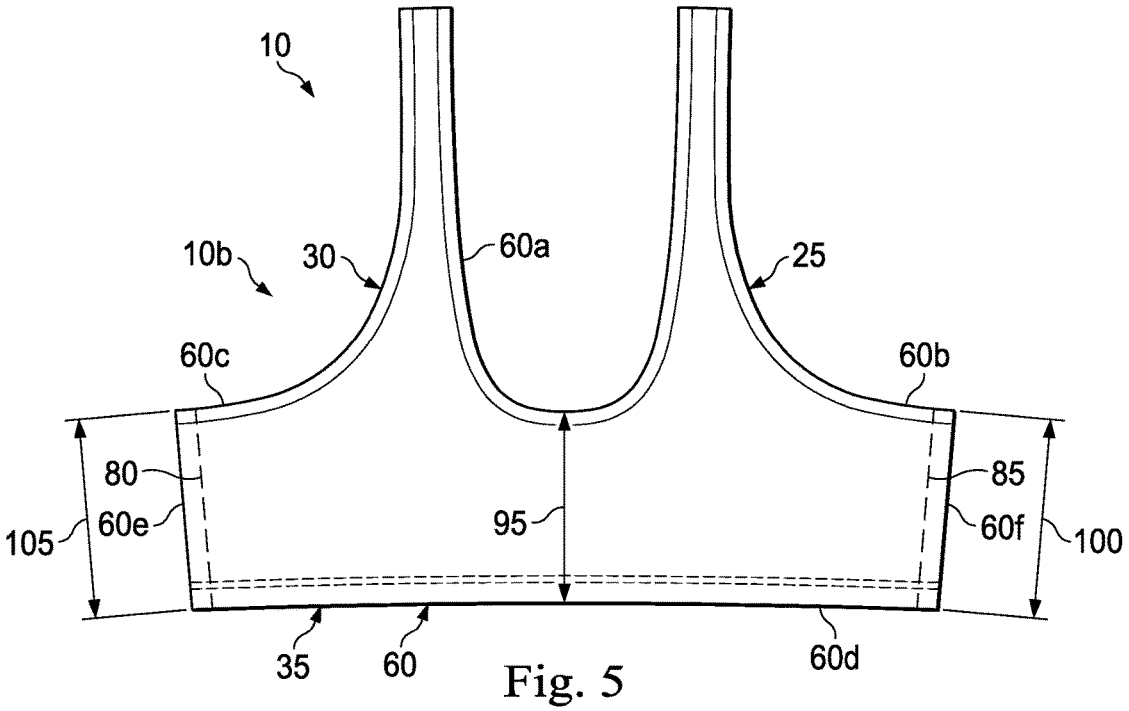
FIG. 5 is an external front view of the back portion of the garment of FIG. 1, according to an exemplary embodiment.
Figure 6:
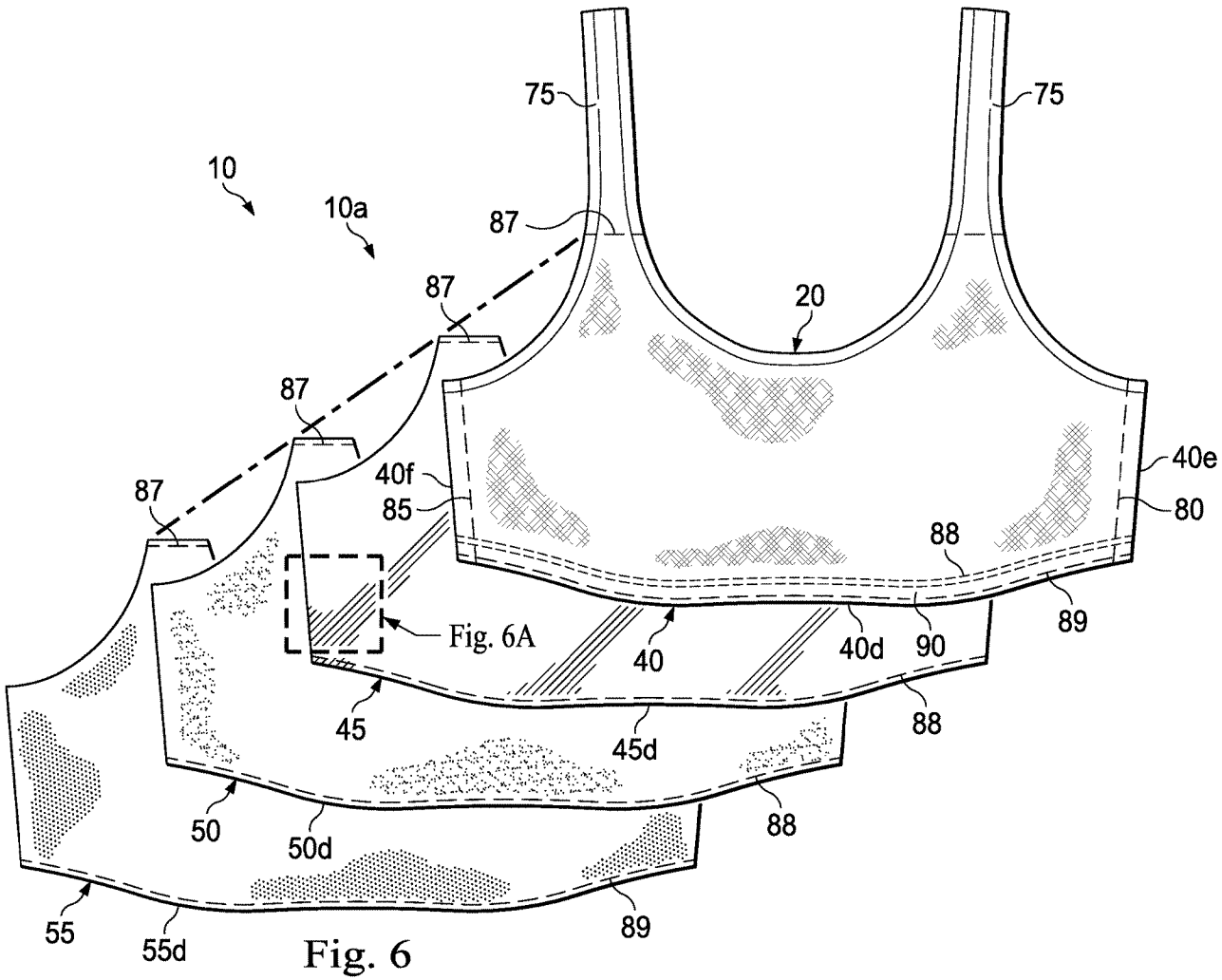
FIG. 6 is a front view of a partially exploded front portion of the garment of FIG. 1, according to an exemplary embodiment, the front portion having a first layer, a second layer, a third layer, and a fourth layer.
Figure 7:
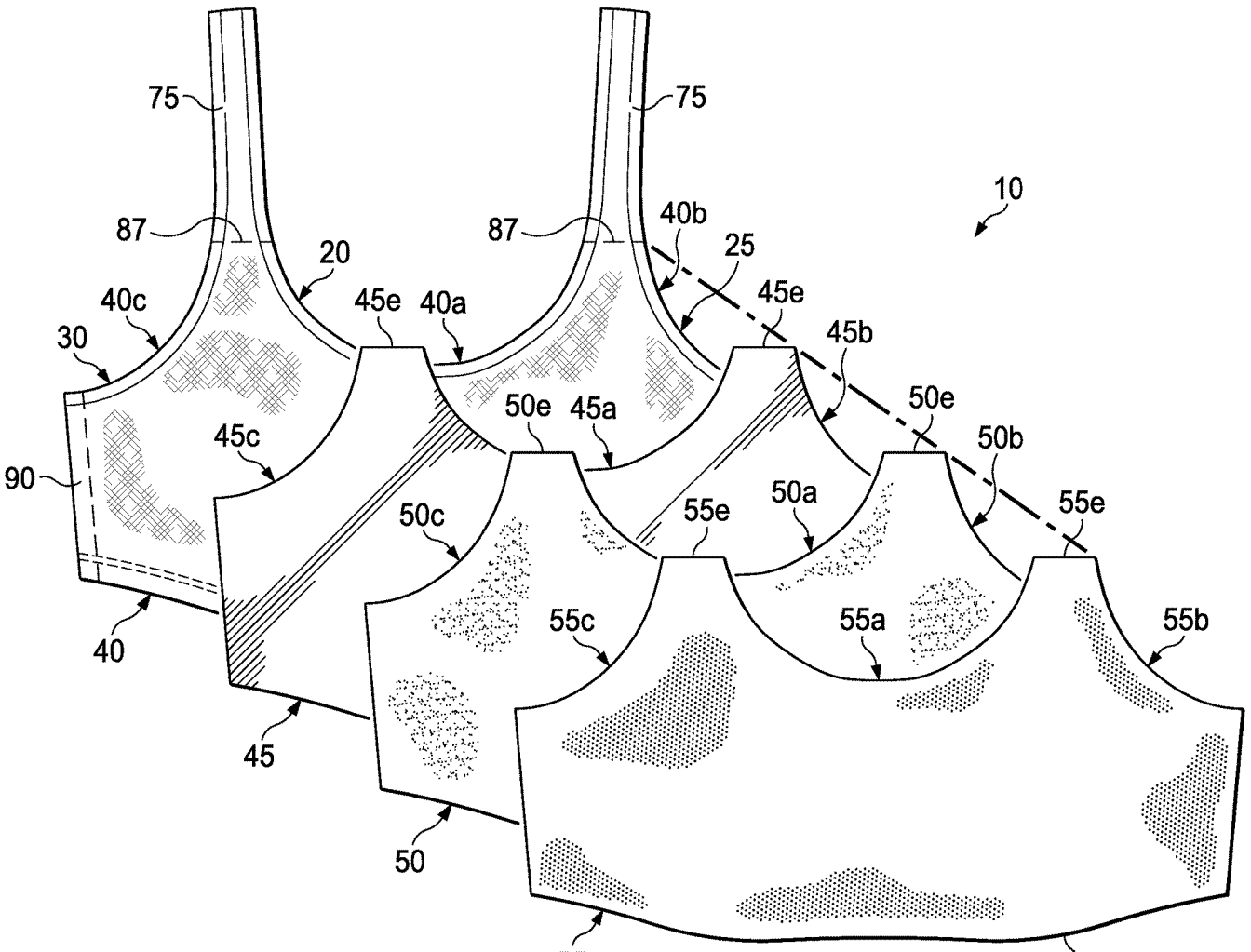
FIG. 7 is a back view of the partially exploded front portion of FIG. 6, according to an exemplary embodiment.

As illustrated in FIGS. 2-5, the garment 10 is configured to be worn by a user 15 and forms a front portion 10*a* relative to the user, and a back portion 10*b* relative to the user 15. As such, the garment 10 forms a head opening 20, an arm opening 25, an opposing arm opening 30, and a torso opening 35. As illustrated in FIGS. 6 and 7, the front portion 10*a* includes an external layer or front outermost layer 40 relative to the user 15, a front first middle layer 45, a front second middle layer 50, and a front innermost layer 55. As shown in FIG. 5, the back portion 10*b* of the garment 10 includes a back layer 60. In an exemplary embodiment, the back layer 60 and the front outermost layer 40 connect to each other, or are otherwise coupled together, and together they make up an outer frame of the garment 10. In an exemplary embodiment, the outer frame of the garment 10 is at least partially formed from an elastic fabric. In an exemplary embodiment, the fabric forming the outer frame of the garment 10 (i.e., the front outermost layer 40 and the back layer 60) is formed from a material that is 95% polyester and 5% spandex. However, any variety of materials or fabrics may be used for the layers 40 and 60. Generally, the layers 40 and 60 are formed from a material that is different from the fabric or material forming the layers 45, 50, and 55.

In an exemplary embodiment, the front first middle layer 45 is polyurethane coated, leak-resistant fabric that serves as a liquid-barrier. In some embodiments, the layer 45 is formed from 100% polyester or other polyester. However, the front first middle layer 45 may be any water resistant and/or waterproof material. In an exemplary embodiment and as illustrated in FIG. 6A, the front first middle layer 45 is cut on a bias (cross-grain) to enable a better fit and better coverage than a cut on the straight grain, while stopping liquids from going through the front first middle layer 45 and into the front outermost layer 40 (i.e., "leaking"). That is, when the front first middle layer 45 is a woven fabric with weft threads 65 having longitudinal axes that are generally perpendicular to longitudinal axes of warp threads 70, the front first middle layer 45 may be cut at an angle about 45 degrees from each of the axes of the weft threads 65 and warp threads 70. However, the front first middle layer 45 may be cut at any angle within the range of about 1 degree to about 89 degrees from either of the longitudinal axes of the weft threads 65 and the warp threads 70. In some instances, and as shown in FIG. 7, the front first middle layer 45 does not extend behind straps 75 that are formed by the front outermost layer 40. That is, the front first middle layer 45 may be omitted from the upper most 6 inches, 5 inches, 4 inches, 3 inches, or 2 inches of the front outermost layer 40 that at least partially forms the straps 75. However, in other embodiments, the front first middle layer 45 is nearly identical in shape to the front outermost layer 40.

In an exemplary embodiment, the second middle layer 50 is an absorbency layer and may include a terrycloth-type fabric. In some embodiments, the layer 50 is formed from 100% polyester or other polyester. However, the front second middle layer 50 may be any type of absorbent material. Generally, the front second middle layer 50 is identically shaped to the front first middle layer 45 and serves as a layer of absorbency.

The front innermost layer 55 is a wicking layer and may include a fleece-type fabric, such as a micro fleece or microfiber fleece material. In an exemplary embodiment, the front innermost layer 55 is a dense polyester fabric made with microfiber yarns that is configured to provide moisture-wicking capability. In some instances, the layer 55 is formed from a material that is 60% polyester and 40% cotton. However, any type of wicking material may be used, such as for example any material including polyester. Generally, the front innermost layer 55 is similar, but not identically shaped to the front second middle layer 50 and serves as a wicking layer that will wick breast milk away from the skin.

In most instances, the layer 40, the first middle layer 45, the second middle layer 50, and the innermost layer 55 are coupled together such that the first middle layer 45 is in contact with and extends between the external layer 40 and the second middle layer 50, and the second middle layer 50 is in contact with and extends between the first middle layer 45 and the innermost layer 55. Generally, the layers 40, 45, 50, and 55 are not removable or "non-removable" from the front portion 10*a* and the garment 10, which is a multi-layer garment.

In an exemplary embodiment and as illustrated in FIGS. 4-7, each of the layers 40, 45, 50, 55, and 60, has an edge 40*a*, 45*a*, 50*a*, 55*a*, and 60*a*, respectively, that is coupled proximate to, or forms a portion of the head opening 20; an edge 40*b*, 45*b*, 50*b*, 55*b*, and 60*b*, respectively, that is coupled proximate to, or forms a portion of the arm opening 25; an edge 40*c*, 45*c*, 50*c*, 55*c*, and 60*c*, respectively, that is coupled proximate to, or forms a portion of the arm opening 30; and an edge 40*d*, 45*d*, 50*d*, 55*d*, and 60*d*, respectively, that is coupled proximate to, or forms a portion of the torso opening 35. Moreover, each of the layers 40 and 60, has an edge 40*e* and 60*e*, respectively, that are coupled together via a stitched seam 80 and an edge 40*f* and 60*f*, that are coupled together via a stitched seam 85. However, the stitched seams 80 and 85 may be replaced with any type of coupling. In some instances, each of the layers 45, 50, and 55 has an upper most edge 45*e*, 50*e*, and 55*e* that is sewn or otherwise coupled to the layer 40 to form a seam 87. In some instances, the layers 45, 50, and 55 are sewn or otherwise coupled to the layer 40 at least via the seam 87 to secure each of the layers 45, 50, and 55 relative to the layer 40. The layers 45 and 50 are shorter than the layers 40 and 55, thus, when the layers 45 and 50 are attached to the layer 40 via the seam, the edges 45*d* and 50*d* are spaced from the edges 40*d* and 55*d*. The edges 45*d* and 50*d* are sewn or otherwise coupled together via a seam 88. Often, the seam 88 is formed using the edges 45*d*, 50*d*, and the layer 40. A seam 89 couples the layer 55 to the layer 40. As shown in FIG. 6, the seams 89 and 88 are spaced in generally parallel arrangement, with the seam 88 being positioned closer to the head opening 20 than the seam 89. Generally, the layer 55 extends between the seam 88 and the user. The spacing and positioning of the seams 87, 88, and 89 relative to the other seams and relative to the user 15 prevent bunching of the garment 10, decrease the weight of the garment 10 in specific areas, and generally improve the comfort to the user 15 when wearing the garment 10. Moreover, the spacing and positioning of the seams 87, 88, and 89 ensure that the layers 45, 50, and 55 remain anchored relative to the layers 40 and 60 even when the garment 10 changes configurations or positions, which decrease or prevent the bunching of one layer relative to another and prevents seams or folds from forming within the layers 45, 50, and 55 to ensure a "seamless" appearance when worn by the user 15.

In some instances, the length of the layer 40 from the top of the strap 75 to the edge 40*d* is approximately 14.224 inches; the width of the layer 40 from the edges 40*e* to 40*f* is approximately between 16.920 inches and 16.205 inches; the length of the layer 45 between the edge 45*e* to the edge 45*d* is approximately 7.422 inches; the width of the layer 45 is approximately between 15.015 inches and 14.627 inches; the length of the layer 50 between the edge 50*e* to the edge

50*d* is approximately 7.422 inches; the width of the layer 50 is approximately between 15.015 inches and 14.627 inches; the length of the layer 55 between the edge 55*e* to the edge 55*d* is approximately 8.235 inches; the width of the layer 55 is approximately between 16.917 inches and 16.227 inches; the length of the layer 60 from the top of the strap 75 to the edge 60*d* is approximately 12.519 inches; and the width of the layer 60 between the edges 60*e* to 60*f* is approximately between 16.758 inches and 15.489 inches. However, any variety of dimensions is contemplated here.

In an exemplary embodiment, an elastic band 90 or the like is coupled to, or at least towards, the lower edges 40*d* and 60*d* of the layers 40 and 60 to provide a bottom support to the garment 10. The elastic band 90 may be sewn directly onto the layers 40 and 60 via a seam, may extend within a tunnel formed within one of the layers 40 or 60, may be sewn directly onto the layer 55 and 60, etc. In some instances, the elastic band 90 is covered in a material that is identical to the material of the layer 55. In some instances, the elastic band 90 has a height of approximately 1 inch. In some instances, the elastic band 90 has a height of greater than 1 inch, such as 1.12 inches, 1.25 inches, 1.5 inches, or 1.75 inches. However, in other instances, the elastic band 90 is omitted and the bottom edges 40*d* and 60*d* of the layers 40 and 60 are sized or otherwise formed to provide the bottom support to the garment 10.

As shown in FIGS. 4 and 5, a first dimension 95 is defined between the edge 60*a* and the edge 60*d*; a second dimension 100 is defined between the edge 60*b* and 60*d* and measured along the edge 60*f*; and a third dimension 105 is defined between the edge 60*c* and 60*d* and measured along the edge 60*e*. In some instances, the first dimension 95 is substantially equal to (within 5%) of at least one of the dimensions 100 and 105. In some instances, the first dimension 95 is within 10% of at least one of the dimensions 100 and 105. Thus, the edge 60*a* forms a U shaped head opening. The U-shaped edge 60*a* enables one, or both, of the straps 75 to be pulled downward over the shoulder of the user 15 to expose one, or both, nipples of the user 15. However, in some instances the first dimension 95 is greater than one or both of the second and third dimensions 100 and 105 to form a "racerback" shape while retaining the ability to expose one or both of the nipples when the garment 10 is in any variety of configurations, such as the second, third, or fourth configuration (described below). Additionally, and in some instances the front portion 10*a* forms an uninterrupted surface providing full breast coverage to the user 15. That is, at least the edge 40*a* continues uninterrupted across the chest of the user 15 to form a U shape. The uninterrupted surface provides full-breast coverage to the user 15.

Figure 2:
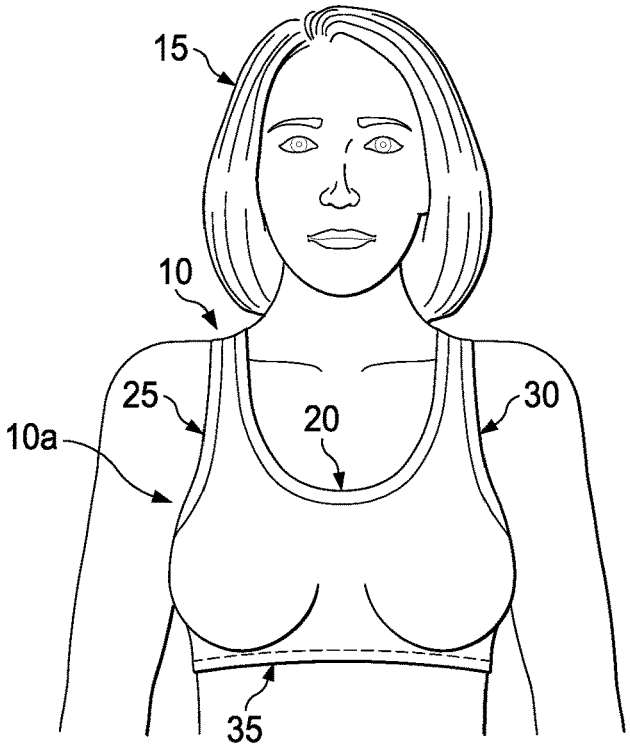
FIG. 2 is another front view of the garment of FIG. 1 in a first configuration and a user, according to an exemplary embodiment.

Generally, the garment 10 is worn by the user 15 in one of four configurations. The first configuration is illustrated in FIGS. 2 and 3 and provides breast support and leak-resistance to both breasts of the user 15. That is, when the front portion 10*a* is covering both nipples of the user 15 and when milk is expressed or leaks from the nipple of the user, the layer 55 wicks milk, from the nipples of the user, away from the user 15. The wicked milk is then transferred from the layer 55 to the layer 50 or absorbed by the layer 50. The layer 45 prevents the milk from further transferring to the layer 40 and thus the milk is captured in the layer 50. As the milk cannot transfer to the layer 40, the garment 10 is a leak-resistant nursing garment.

Figure 8:
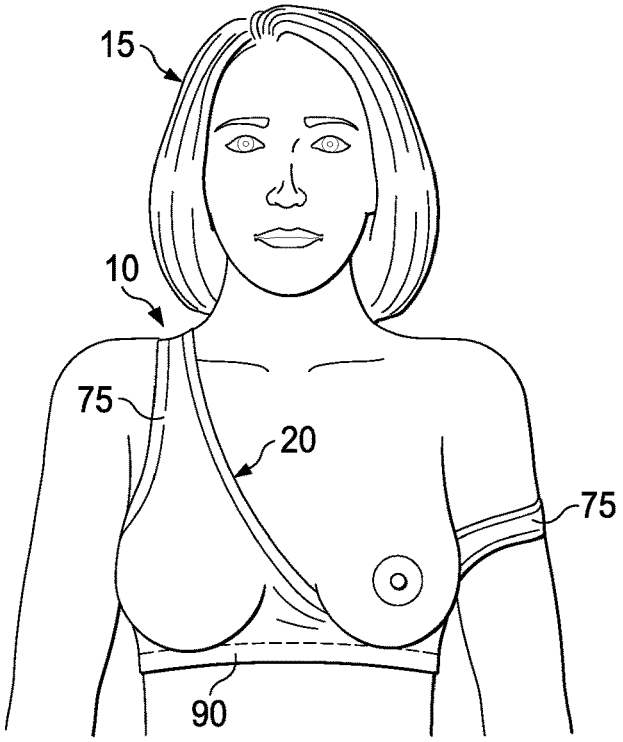
FIG. 8 is a front view of the garment of FIG. 1 in a second configuration and the user, according to an exemplary embodiment.
Figure 9:
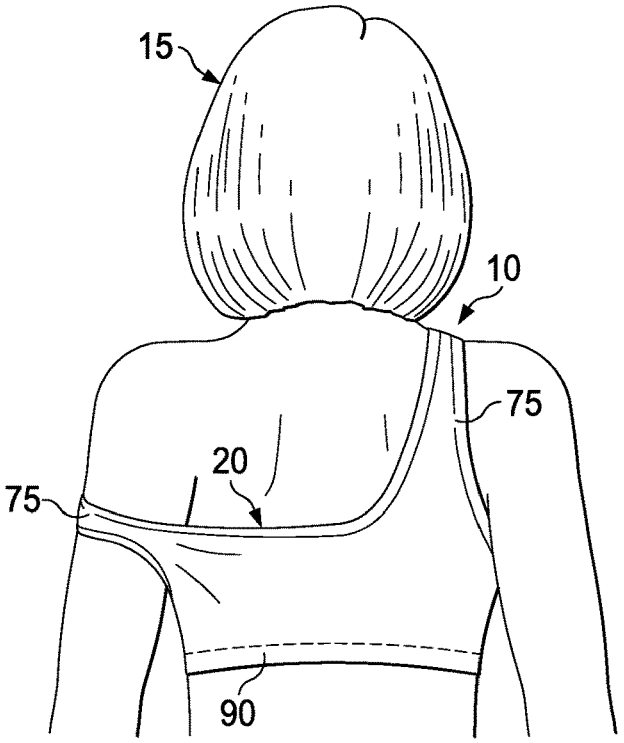
FIG. 9 is a back view of the garment of FIG. 1 in the second configuration and the user, according to an exemplary embodiment.

FIGS. 8 and 9 illustrate the garment 10 in a second configuration relative to the user 15. In the second configuration, one of the straps 75 has been lowered to below the shoulder of the user 15 to expose a nipple while the other strap 75 remains on the shoulder of the user 15. Generally, the second configuration is associated with breastfeeding a child or otherwise expressing milk (via pump, etc.). As the other nipple is generally still covered by the front portion 10*a* in the second configuration, any milk that leaks from the other nipple during expression of milk from the exposed nipple will be captured in the front portion 10*a* in the same manner as described above regarding the first configuration. In the second configuration, the elastic band 90 is secured relative to a torso of the user 15 at a location below the breasts of the user 15. Generally, the deep U-shape of the head opening 20 (in the front portion 10*a* and the back portion 10*b*) of the garment 10 encourages the exposure of the one nipple in the second configuration. That is, the dimension 95 being substantially equal or within 10% of one of the second and third dimensions 100 and 105 allows for one of the straps 75 (or both in some instances) to be lowered to the second configuration.

Figure 10:
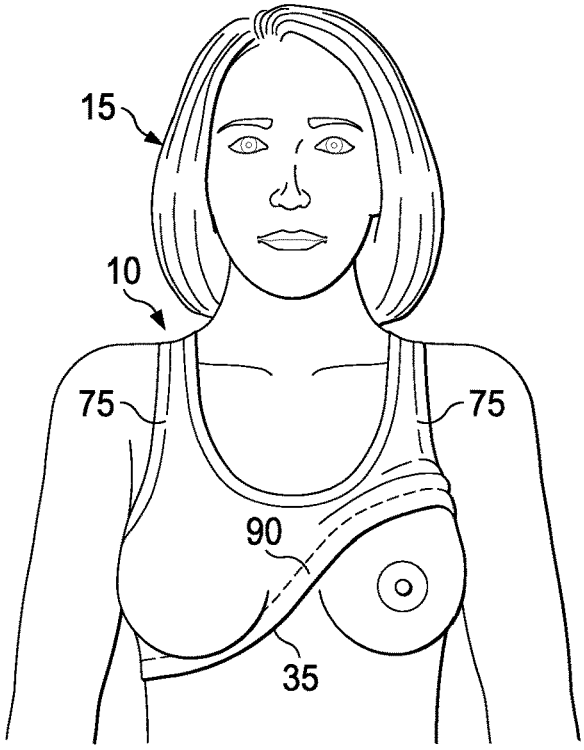
FIG. 10 is a front view of the garment of FIG. 1 in a third configuration and the user, according to an exemplary embodiment.
Figure 11:
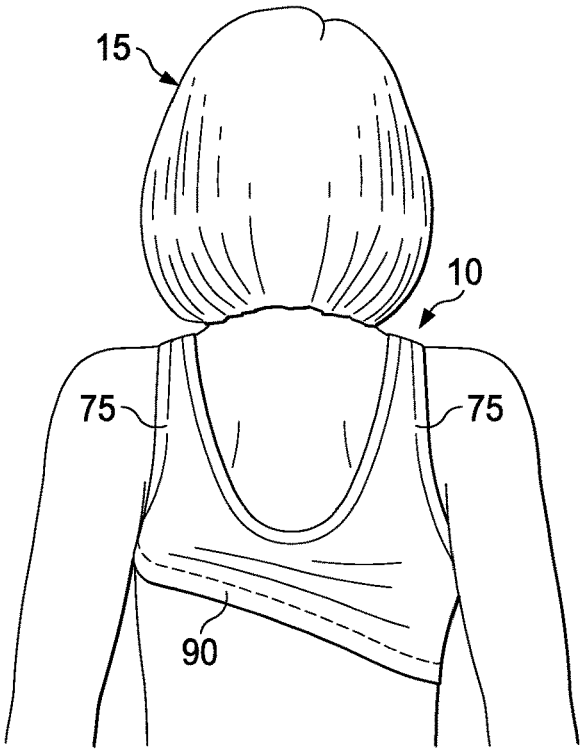
FIG. 11 is a back view of the garment of FIG. 1 in the third configuration and the user, according to an exemplary embodiment.

FIGS. 10 and 11 illustrate the garment 10 in a third configuration relative to the user 15. In the third configuration, a portion of the elastic band 90 has been raised above one of the nipples of the user 15 to expose the nipple of the user 15. Generally, the third configuration is associated with breastfeeding a child or otherwise expressing milk using the exposed nipple (via pump, etc.). As the other nipple is generally still covered by the front portion 10*a* in the second configuration, any milk that leaks from the other nipple during expression of milk from the exposed nipple will be captured in the front portion 10*a* in the same manner as described above regarding the first configuration. In the third configuration, both straps 75 remain on the shoulders of the user 15 while the elastic band 90 is raised from a position below both breasts of the user 15 to a position near the armpit of the user 15 such that at least one nipple of the user 15 is exposed.

Figure 12:
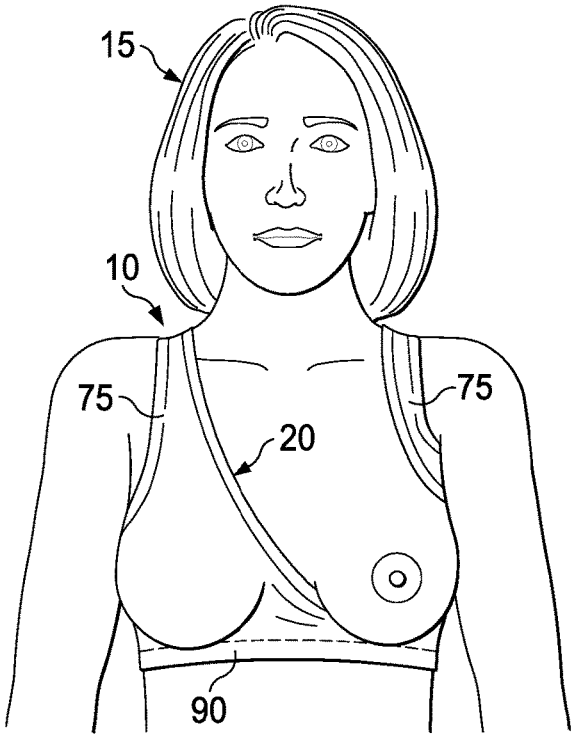
FIG. 12 is a front view of the garment of FIG. 1 in a fourth configuration and the user, according to an exemplary embodiment.

FIG. 12 illustrates the garment 10 in a fourth configuration relative to the user 15. In the fourth configuration, the entirety of the elastic band 90 is positioned below the nipples of the user 15 while both straps 75 remain on the shoulders of the user 15. However, in the fourth configuration, the edge 40*a* is pulled below at least one of the nipples of the user 15 such that the nipple extends through the head opening 20 to expose the nipple of the user 15. Generally, the fourth configuration is associated with breastfeeding a child or otherwise expressing milk using the exposed nipple (via pump, etc.). As the other nipple is generally still covered by the front portion 10*a* in the second configuration, any milk that leaks from the other nipple during expression of milk from the exposed nipple will be captured in the front portion 10*a* in the same manner as described above regarding the first configuration.

In some instances, the layer 45 is coupled to the layer 40 such that the axes of the weft threads 65 and warp threads 70 are positioned at an angle between 25 degrees and 65 degrees from either the first seam 80 or the second seam 85 to encourage the garment 10 to move from the first configuration to the second configuration, from the first configuration to the third configuration, and/or from the first configuration to the fourth configuration. Moreover, each of the edges 45*d*, 50*d*, and 55*d* may be coupled to the layer 40 and/or to one of the other layers 40, 45, 50, and 55 at a location near the edge 40*d* or at a location that is spaced from the edge 40*d* and/or the elastic band 90. That is, each of the lower edges 45*d*, 50*d*, and 55*d* of the layers 45, 50, and 55 may be coupled to the garment 10 at a location that is staggered from the elastic band 90 to prevent a large and/or noticeable seam that could agitate the user 15. In some instances, the layers 45 and 50 have smaller dimensions than the layers 40 and 55. In some instances, the layer 45 is a laminate material that is cut on cross fabric grain, the layer 50 is a towel material cut on the fabric grain, and the layer 55 is a velour material cut on the fabric grain. However, the layer 50 and/or the layer 55 are cut off grain in some instances.

After breastfeeding or otherwise expressing milk, the user 15 can easily move the garment 10 back into the first configuration to again provide breast support for both breasts and leak protection. To remove milk captured in the garment 10, the garment 10 can be rinsed or otherwise laundered. After rinsing or laundering, the garment 10 can be worn again. Thus, the garment 10 is a reusable nursing garment. Due to the coupling of the layers 40, 45, 50, and 55 together, the layers 40, 45, 50 and 55 remain substantially stationary relative to each other even after moving between the first, second, third, and fourth configurations. While the first, second, third, and fourth configurations have been described relative to the placement of the elastic band 90, the function and configurations are the same if no elastic band 90 is provided, in which case the bottom edges 40*d* and 60*d* are positioned and moved in relation to the user 15 in one or more of the first, second, third, and fourth configurations.

When the front innermost layer 55 is made of soft polyester or other equivalent material, the front innermost layer 55 does not stick to sore and/or chapped nipples. Thus, the garment 10 provides a comfortable garment for the wearer or the user 15 of the garment 10. In addition, when the material of the leak-resistant first middle layer 45 is cut on a bias (cross grain), it is capable of both providing support to the user when the user is not breastfeeding a baby while also being easily stretchable, when access by a baby is required for breast feeding, by pulling down on one of the shoulder straps 75 to expose a unitary nipple, by lifting-up the band 90 of the garment 10 for breast exposure and a beneficial skin-to-skin experience with the baby, and by pulling the head opening 20 down below the nipple. As the leak-resistance is incorporated into the garment 10, the use of a separate nursing pad is avoided and the garment 10 is convenient in that there is no worry of misplaced or lost nursing pads. Additionally, the garment 10 provides discrete leak-protection in that the front first middle layer 45 is integrated with, or forms a portion of, the garment 10 itself. Thus, the garment 10 may be worn without a nursing pad that can be seen through an outer garment worn over the garment 10. As such, the garment 10 provides a "seamless" or "smooth" surface associated with the breast on which the outer garment can lie, thereby providing discrete leak-protection.

In some instances, the garment 10 may be worn by a pregnant, nursing, or non-nursing wearer or user. The garment 10 may be worn during any occasion, such as for example, sleeping, working, exercising, etc. In an exemplary embodiment, one or more of the layers 40-55 is configured or shaped for full breast coverage. As shown, the garment 10 has a U shaped head opening 20 that secures both breasts while the garment 10 is in the first configuration. However, in some instances, the garment 10 has a "criss-cross" of layers that forms a deep V shape in the head opening of the garment 10 to provide full breast coverage.

Figure 13:
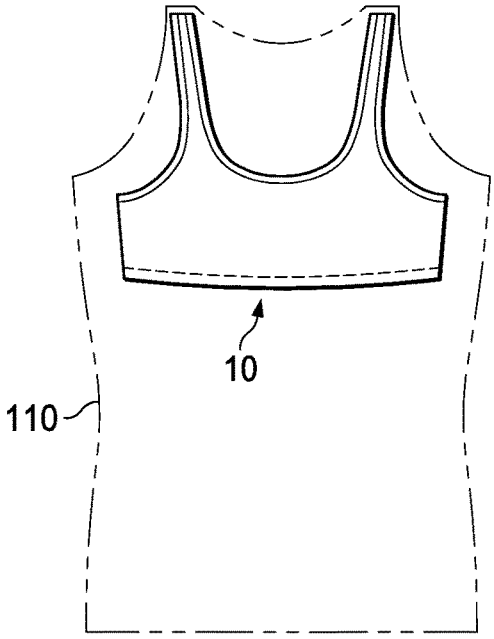
FIG. 13 is a front view of another garment superimposed over the garment of FIG. 1, according to an exemplary embodiment.
Figure 14:
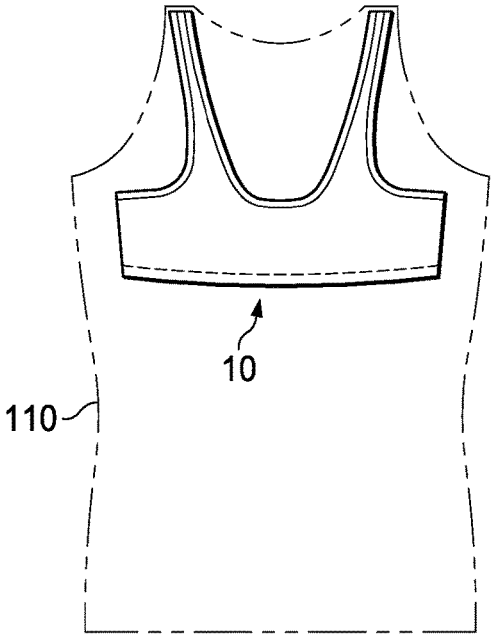
FIG. 14 is a back view of the another garment of FIG. 12 superimposed over the garment of FIG. 1, according to an exemplary embodiment.

In a variety of different embodiments, the garment 10 may be incorporated into and/or worn with a tank top 110 as illustrated in FIGS. 13 and 14, a jumpsuit, a sun dress, a night shirt, a camisole, a blouse, a shirt, a day bra, a sweater, a sport shirt, any type of lounge wear, sleepwear, tee shirt, brassiere and/or dress, with short or three quarters length, long sleeves, cap sleeves, or any style sleeves. In an exemplary embodiment, the garment 10 is a sleep brassiere.

As shown, the straps 75 of the garment 10 are continuous and do not include snaps or other detachable connectors that would enable the front portion 10*a* to temporarily separate from the back portion 10*b*. However, in other instances the straps 75 of the garment 10 are adjustable in length.

In one aspect, the present disclosure is directed to a nursing garment. The nursing garment includes a back portion that includes a back layer; and a front portion coupled to the back portion, the front portion including: an external layer; a first middle layer that includes a leak-resistant fabric having at least one edge that is cut on the bias; a second middle layer that includes an absorbent material; and an innermost layer configured to be in contact with a nipple of a user, wherein the innermost layer includes a fabric configured to wick moisture away from the nipple of the user; wherein the external layer, the first middle layer, the second middle layer and the innermost layer are coupled together such that the first middle layer extends between the external layer and the second middle layer, and the second middle layer extends between the first middle layer and the innermost layer. In one aspect, the front portion is sewn to the back portion; and wherein the external layer, the first middle layer, the second middle layer, and the innermost layer are sewn together such that each is non-removable from the garment. In one aspect, the back portion and the front portion together form a head opening, a first arm opening, a second opposing arm opening, and a torso opening. In one aspect, an edge of the front portion that forms the head opening is U shaped. In one aspect, an edge of the back portion that forms the head opening is U shaped. In one aspect, the garment also includes an elastic band that is coupled each of the front portion and the back portion and that is sized to secure the garment relative to the torso of the user. In one aspect, the garment is movable between a first configuration and a second configuration; wherein, when in the first configuration, two shoulder straps that form at least a portion of the head opening rest on the shoulders of the user and the elastic band is positioned below the breasts of the user such that both nipples of the user are covered by the front portion of the garment; and wherein, when in the second configuration, the elastic band is positioned below the breasts of the user and at least one of the shoulder straps is positioned below a shoulder of the user and such that at least one nipple of the user is not covered by the front portion of the garment. In one aspect, each of the back layer and the external layer has a first edge and an opposing second edge; wherein each of the first edges of the back layer and the external layer are coupled to form a first side seam; wherein each of the second edges of the back layer and the external layer are coupled to form a second side seam; wherein the leak-resistant fabric is a woven fabric including weft threads having longitudinal axes that are substantially perpendicular (within 5 degrees) to longitudinal axes of warp threads, and wherein the leak-resistant fabric is coupled to the external layer such that the axes of the weft and warp threads are positioned at an angle between 25 degrees and 65 degrees from either the first side seam or the second side seam to encourage the garment to move from the first configuration to the second configuration. In one aspect, the back portion defines a first dimension extending between the U-shaped head opening and a bottom edge of the back portion; wherein the back portion defines a second dimension extending between either the first or second opposing arm opening and the bottom edge, wherein the first dimension is substantially equal to the second dimension. In one aspect, the first dimension being substantially equal to the second dimension encourages the at least one shoulder strap to be positioned below the shoulder of the user when the garment is in the second configuration. In one aspect, the garment is movable between a first configuration and a third configuration; wherein, when in the first configuration, two shoulder straps that form at least a portion of the head opening rest on the shoulders of the user and the elastic band is positioned below the breasts of the user such that both nipples of the user are covered by the front portion of the garment; and wherein, when in the third configuration, the two shoulder straps remain resting on the shoulders of the user and at least a portion of the elastic band is positioned above at least one of the nipples of the user such that the at least one nipple of the user is not covered by the front portion of the garment. In one aspect, the garment is sewn into another garment that is selected from the group consisting of a sleep brassiere, a night shirt, a camisole, a jumpsuit, a t-shirt, a tank top, and a dress. In one aspect, each of the straps is non-detachable from either the front portion or the back portion of the garment. In one aspect, the first middle layer includes a polyurethane coated polyester material. In one aspect, the second middle layer includes a polyester material.

In another aspect, the present disclosure is directed to a method of capturing expressed milk. The method includes positioning a front portion of a multi-layer garment over a first nipple of a user; wherein the front portion includes: an external layer; a first middle layer that includes a leak-resistant fabric having at least one edge that is cut on the bias; a second middle layer that includes an absorbent material; and an innermost layer configured to be in contact with the first nipple of a user; wicking milk from the first nipple of the user away from the user using the innermost layer; transferring the milk from the innermost layer to the second middle layer that is in direct contact with the innermost layer; capturing the milk in the second middle layer; and preventing, using the first middle layer, the further transfer of the milk from the second middle layer to the external layer. In one aspect, the external layer, the first middle layer, the second middle layer, and the innermost layer are sewn together such that each is non-removable from the garment. In one aspect, the multi-layered garment is a bra including the front portion and a back portion; wherein the back portion and the front portion together form a head opening, a first arm opening, a second opposing arm opening, and a torso opening; and wherein the method further includes positioning the back portion of the garment around the back of the user. In one aspect, the multi-layer garment further includes an elastic band coupled to each of the front portion and the back portion and that is sized to secure the bra to the torso of the user; wherein the method further includes: moving the bra from a first configuration to a second configuration; wherein, when in the first configuration, two shoulder straps that form at least a portion of the head opening rest on the shoulders of the user and the elastic band is positioned below the first nipple and a second nipple of the user such that both nipples of the user are covered by the front portion of the garment; and wherein, when in the second configuration, the elastic band is positioned below the first and second nipples of the user and at least one of the shoulder straps is positioned below one shoulder of the user and such that the second nipple is not covered by the front portion of the garment; and expressing milk from the second nipple when the bra is in the second configuration. In one aspect, the multi-layer garment further includes an elastic band coupled to each of the front portion and the back portion and that is sized to secure the bra to the torso of the user; wherein the method further includes moving the bra from a first configuration to a third configuration; wherein, when in the first configuration, two shoulder straps that form at least a portion of the head opening rest on the shoulders of the user and the elastic band is positioned below the first nipple and a second nipple of the user such that both nipples of the user are covered by the front portion of the garment; and wherein, when in the third configuration, the two shoulder straps remain resting on the shoulders of the user and at least a portion of the elastic band is positioned above the second nipple such that the second nipple is not covered by the front portion of the garment; and expressing milk from the second nipple when the bra is in the third configuration. In some instances, the multi-layer garment further includes an elastic band coupled to each of the front portion and the back portion and that is sized to secure the bra to the torso of the user; wherein the method further includes moving the bra from a first configuration to a fourth configuration; wherein, when in the first configuration, two shoulder straps that form at least a portion of the head opening rest on the shoulders of the user and the elastic band is positioned below the first nipple and a second nipple of the user such that both nipples of the user are covered by the front portion of the garment; and wherein, when in the fourth configuration, the two shoulder straps remain resting on the shoulders of the user, the entirety of the elastic band is positioned below the nipples, and the head opening is pulled below at least the second nipple such that the second nipple is not covered by the front portion of the garment; and expressing milk from the second nipple when the bra is in the fourth configuration The present invention is not to be limited in scope by the embodiment disclosed in the examples, which are intended as illustrations of the aspects of the invention, and any methods, which are functionally equivalent, are within the scope of the invention. Indeed, various modifications of the invention in addition to those shown and described herein will become apparent to those skilled in the art from the foregoing description. Such modifications are intended to fall within the scope of the appended claims.

Those skilled in the art will recognize, or be able to ascertain using no more than routine experimentation, and equivalents to the specific embodiments of the invention described herein. Such equivalents are intended to be encompassed by the claims.

What is claimed is:

1. A nursing garment, the garment comprising:

a back portion comprising a back layer; and a front portion coupled to the back portion, the front portion comprising:

an external layer;

a first middle layer that comprises a leak-resistant fabric having at least one edge that is cut on a bias;

wherein the leak-resistant fabric is situated to lie on the bias within the garment;

a second middle layer that comprises an absorbent material; and an innermost layer configured to be in contact with a nipple of a user, wherein the innermost layer comprises a fabric configured to wick moisture away from the nipple of the user;

wherein the external layer, the first middle layer, the second middle layer and the innermost layer are coupled together such that the first middle layer extends between the external layer and the second middle layer, and the second middle layer extends between the first middle layer and the innermost layer.

2. The garment of claim 1, wherein the front portion is sewn to the back portion; and wherein the external layer, the first middle layer, the second middle layer, and the innermost layer are sewn together such that each is non-removable from the garment.

3. The garment of claim 1, wherein the back portion and the front portion together form a head opening, a first arm opening, a second opposing arm opening, and a torso opening.

4. The garment of claim 2, wherein an edge of the front portion that forms the head opening is U shaped.

5. The garment of claim 2, wherein an edge of the back portion that forms the head opening is U shaped.

6. The garment of claim 3, further comprising an elastic band that is coupled to each of the front portion and the back portion and that is sized to secure the garment relative to a torso of the user.

7. The garment of claim 6, wherein the garment is movable between a first configuration and a second configuration;

wherein, when in the first configuration, two shoulder straps that form at least a portion of the head opening are configured to rest on shoulders of the user and the elastic band is adapted to be positioned below breasts of the user such that both nipples of the user are covered by the front portion of the garment; and wherein, when in the second configuration, the elastic band is adapted to be positioned below the breasts of the user and at least one of the shoulder straps is configured to be positioned below a shoulder of the user and such that at least one nipple of the user is not covered by the front portion of the garment.

8. The garment of claim 7, wherein each of the back layer and the external layer has a first edge and an opposing second edge;

wherein each of the first edges of the back layer and the external layer are coupled to form a first side seam;

wherein each of the second edges of the back layer and the external layer are coupled to form a second side seam;

wherein the leak-resistant fabric is a woven fabric comprising weft threads having longitudinal axes that are substantially perpendicular to longitudinal axes of warp threads, and wherein the leak-resistant fabric is coupled to the external layer such that the axes of the weft and warp threads are positioned at an angle between 25 degrees and 65 degrees from either the first side seam or the second side seam to encourage the garment to move from the first configuration to the second configuration.

9. The garment of claim 8, wherein the back portion defines a first dimension extending between the U-shaped head opening and a bottom edge of the back portion; wherein the back portion defines a second dimension extending between either the first or second opposing arm opening and the bottom edge, wherein the first dimension is substantially equal to the second dimension.

10. The garment of claim 9, wherein the first dimension being substantially equal to the second dimension encourages the at least one shoulder strap to be configured to be positioned below the shoulder of the user when the garment is in the second configuration.

11. The garment of claim 6, wherein the garment is movable between a first configuration and a third configuration;

wherein, when in the first configuration, two shoulder straps that form at least a portion of the head opening are configured to rest on shoulders of the user and the elastic band is adapted to be positioned below breasts of the user such that both nipples of the user are covered by the front portion of the garment; and wherein, when in the third configuration, the two shoulder straps remain configured to be resting on the shoulders of the user and at least a portion of the elastic band is adapted to be positioned above at least one of the nipples of the user such that the at least one nipple of the user is not covered by the front portion of the garment.

12. The garment of claim 6, wherein the garment is movable between a first configuration and a fourth configuration;

wherein, when in the first configuration, two shoulder straps that form at least a portion of the head opening are configured to rest on shoulders of the user and the elastic band is adapted to be positioned below breasts of the user such that both nipples of the user are covered by the front portion of the garment; and wherein, when in the fourth configuration, the two shoulder straps remain configured to be resting on the shoulders of the user, the entirety of the elastic band is adapted to be positioned below the nipples, and the head opening is configured to be pulled below at least one of the nipples of the user such that the at least one nipple of the user is not covered by the front portion of the garment.

13. The garment of claim 1, wherein the garment is sewn into another garment that is selected from the group consisting of a sleep brassiere, a night shirt, a camisole, a jumpsuit, a t-shirt, a tank top, and a dress.

14. The garment of claim 1, wherein the first middle layer comprises a polyurethane coated polyester material; and wherein the second middle layer comprises a polyester material.

15. A method of capturing expressed milk, the method comprising:

positioning a front portion of a multi-layer garment over a first nipple of a user;

wherein the front portion comprises:

an external layer;

a first middle layer that comprises a leak-resistant fabric having at least one edge that is cut on a bias;

wherein the leak-resistant fabric is situated to lie on the bias within the garment;

a second middle layer that comprises an absorbent material; and an innermost layer configured to be in contact with the first nipple of the user; wherein the innermost layer comprises a fabric configured to wick moisture away from the nipple of the user;

wicking milk from the first nipple of the user away from the user using the innermost layer;

transferring the milk from the innermost layer to the second middle layer that is in direct contact with the innermost layer;

capturing the milk in the second middle layer; and preventing, using the first middle layer, the further transfer of the milk from the second middle layer to the external layer.

16. The method of claim 15, wherein the external layer, the first middle layer, the second middle layer, and the innermost layer are sewn together such that each is non-removable from the garment.

17. The method of claim 16, wherein the multi-layered garment is a bra comprising the front portion and a back portion;

wherein the back portion and the front portion together form a head opening, a first arm opening, a second opposing arm opening, and a torso opening; and wherein the method further comprises positioning the back portion of the garment around a back of the user.

18. The method of claim 17, wherein the multi-layer garment further comprises an elastic band coupled to each of the front portion and the back portion and that is sized to secure the bra to a torso of the user;

wherein the method further comprises:

moving the bra from a first configuration to a second configuration;

wherein, when in the first configuration, two shoulder straps that form at least a portion of the head opening rest on shoulders of the user and the elastic band is positioned below the first nipple and a second nipple of the user such that both nipples of the user are covered by the front portion of the garment; and wherein, when in the second configuration, the elastic band is positioned below the first and second nipples of the user and at least one of the shoulder straps is positioned below one shoulder of the user and such that the second nipple is not covered by the front portion of the garment; and expressing milk from the second nipple when the bra is in the second configuration.

19. The method of claim 17, wherein the multi-layer garment further comprises an elastic band coupled to each of the front portion and the back portion and that is sized to secure the bra to a torso of the user;

wherein the method further comprises:

moving the bra from a first configuration to a third configuration;

wherein, when in the first configuration, two shoulder straps that form at least a portion of the head opening rest on shoulders of the user and the elastic band is positioned below the first nipple and a second nipple of the user such that both nipples of the user are covered by the front portion of the garment; and wherein, when in the third configuration, the two shoulder straps remain resting on the shoulders of the user and at least a portion of the elastic band is positioned above the second nipple such that the second nipple is not covered by the front portion of the garment; and expressing milk from the second nipple when the bra is in the third configuration.

20. The method of claim 17, wherein the multi-layer garment further comprises an elastic band coupled to each of the front portion and the back portion and that is sized to secure the bra to a torso of the user;

wherein the method further comprises:

moving the bra from a first configuration to a fourth configuration;

wherein, when in the first configuration, two shoulder straps that form at least a portion of the head opening rest on shoulders of the user and the elastic band is positioned below the first nipple and a second nipple of the user such that both nipples of the user are covered by the front portion of the garment; and wherein, when in the fourth configuration, the two shoulder straps remain resting on the shoulders of the user, the entirety of the elastic band is positioned below the nipples, and the head opening is pulled below at least the second nipple such that the second nipple is not covered by the front portion of the garment; and expressing milk from the second nipple when the bra is in the fourth configuration.

* * * * *